US005682170A

United States Patent [19]

Kotha et al.

[11] Patent Number: 5,682,170

[45] Date of Patent: Oct. 28, 1997

[54] APPARATUS AND METHOD FOR HORIZONTALLY AND VERTICALLY POSITIONING A VGA DISPLAY IMAGE ON THE SCREEN OF A FLAT PANEL DISPLAY

[75] Inventors: Sridhar Kotha, Fremont; Alexander Eglit, San Carlos; Robin Han, Saratoga, all of Calif.

[73] Assignee: Cirrus Logic, Inc., Fremont, Calif.

[21] Appl. No.: 509,651

[22] Filed: Jul. 31, 1995

Related U.S. Application Data

[62] Division of Ser. No. 235,827, Apr. 29, 1994, Pat. No. 5,521,614.

[51] Int. Cl.[6] ..... G09G 3/00; G09G 5/00

[52] U.S. Cl. ..... 345/3; 345/118

[58] Field of Search ..... 345/3, 118–125

[56] References Cited

U.S. PATENT DOCUMENTS

| | | | |
|---|---|---|---|
| 4,630,039 | 12/1986 | Shimada . | |
| 4,746,981 | 5/1988 | Nadan et al. . | |
| 4,990,904 | 2/1991 | Zenda | 345/3 |
| 5,111,190 | 5/1992 | Zenda | 345/3 |
| 5,285,192 | 2/1994 | Johary et al. | 345/3 |
| 5,293,474 | 3/1994 | Patil et al. . | |
| 5,371,513 | 12/1994 | Drako et al. | 345/118 |
| 5,396,258 | 3/1995 | Zenda | 345/3 |

OTHER PUBLICATIONS

Sutty & Blair, Advanced Programmer's Guide to the EGA/VGA (1988), pp. 19–23, 26–27, 44–51.

Ferraro, Progammer's Guide to the EGA and VGA Cards (1993), pp. 278–284.

U.S. application Ser. No. 07/890,525, Uhlin and Lin filed May 28, 1992.

*Primary Examiner*—Jeffery Brier

*Attorney, Agent, or Firm*—Lowe, Price, Leblanc & Becker; Steven Shaw

[57] ABSTRACT

A method and apparatus for horizontally and vertically positioning a video graphics adapter (VGA) display image on the screen of a flat panel display (FPD) is provided with a first counter for setting a horizontal FPD disable period associated with the FPD. A second counter sets the horizontal FPD enable period of the FPD. This horizontal FPD enable period is greater than a composite horizontal pixel time of a VGA image to be displayed. A first circuit controls the start time of a subsequent horizontal FPD enable period. This start time is based on the horizontal FPD disable period. A second circuit controls the end time of the subsequent horizontal FPD enable period. This end time is based on the horizontal FPD enable period. The VGA display image is begun based on the start time of the subsequent horizontal FPD enable period to locate the VGA display image at a desired horizontal position of the FPD screen. The vertical positioning of the image is performed by similar counters and circuits.

12 Claims, 20 Drawing Sheets

SCANLINE END PULSE 0
1
2
3
4

900C
DUP 0
1
2
0
1
2

901C
DUP 0
1
2
0
1
2

902C
DUP

APPARATUS AND METHOD FOR HORIZONTALLY AND VERTICALLY POSITIONING A VGA DISPLAY IMAGE ON THE SCREEN OF A FLAT PANEL DISPLAY

This application is a division of application Ser. No. 08/235,827 filed Apr. 29, 1994, now U.S. Pat. No. 5.521.614.

FIELD OF THE INVENTION

This invention relates generally to computer graphics display, and more particularly to (1) the expansion of standard VGA modes on large panel displays, and (2) to the positioning of standard VGA modes on large panel displays.

BACKGROUND OF THE INVENTION

A principal product of the so-called "information age" is that information, at one time difficult to find and retrieve, can be made available instantaneously at a person's finger tips. While the advent of computers helped to bring about the information age, the information age is also expected to fuel further evolution in computer technology. Computer systems of the future will be faster, more con,pact, ergonomical, and user friendly.

The display continues to be a critical part of the any computer system, displaying anything from typical alphanumerics to multiple windows of information containing graphics, video, as well as interactive menus and control. With the emphasis on multi-media, displays must be larger, have improved contrast and color, and be of higher resolution.

Presently, most displays use Cathode Ray Tube (CRT) technology because it is a mature technology and therefore cost effective. In addition, CRT displays offer good brightness, contrast, colors, resolution, reliability, as well as wide viewing angle. However, CRT displays are big, heavy, and consume considerable power. CRTs also produce x-rays and low-frequency magnetic fields that are believed to cause health hazards. The present trend toward computer portability as indicated by the proliferation of laptops has created requirements in size, weight, and power consumption that CRTs are unable to meet. As such, flat-panel display (FPD) technology is being used instead of CRT technology for laptops, notebooks, etc.

Currently, there are several types of FPD, including passive-matrix liquid crystal displays (LCDs), active-matrix LCDs, AC plasma display panels, AC thin-film electroluminescent, field-emission displays, vacuum-fluorescent displays, and LEDs. At this time, despite some setbacks, active-matrix LCD is the best performing FPD in terms of color, contrast, and brightness. As advances in LCD technology continue to be made, the size of LCDs continues to grow. Indeed, LCDs of the size of 800×600 pixels has begun to replace 640×480 LCDs as the industry standard. Even larger size LCDs (e.g., 1024×768, 1280×1024, etc.) have been made available.

In many ways, the availability of larger LCDs has created new challenges for graphics cards used in controlling video displays. Presently, the Video Graphics Array (VGA) has established itself as the predominant graphics card used in the Personal Computer (PC) family of computers. VGA controllers are being used in PC platforms ranging from laptops to desktops. The current graphics resolution standard for VGA controllers is 640×480 pixels. Given this resolution standard, large monitors (e.g., 800×600 pixels, 1024×768 pixels, and 1,280×1,024 pixels) that are becoming available pose challenges to the current VGA graphics controllers.

While the challenges presented by large screens affect both CRTs and FPDs, they have a more direct effect on FPDs, more particularly LCDs. The reason is that FPDs have a fixed number of pixels and lines that are lighted when the monitor is in use regardless of the size of the graphics displayed on the screen. As such, when the LCD screen size is larger than the VGA standard graphics resolution of 640×480 pixels, the display on the screen does not utilize the full screen area available. Additionally, the display would not be centered on the LCD screen.

On the other hand, CRTs have more flexibility than FPDs. Among other things, CRTs have the ability to adjust the size of the pixels to fill the screen. That is, while the graphics resolution remains at 640×480 pixels, the size of pixels is enlarged so that the full screen area is utilized. However, since the same number of pixels are now spread over a larger square area, the dot-per-inch (DPI) density of display decreases resulting in a degradation in sharpness.

While there exist other graphics card formats (e.g., Super VGA, XGA) that are designed for larger graphics resolution, they remain prohibitively expensive because they have not yet gained acceptance as industry standards. For this reason, what is needed is a VGA controller card with a standard resolution format of 640 ×480 pixels that is capable of duplicating the number of pixels to fill the full screen area of a large FPD (e.,g., 800×600 pixels resolution). More specifically, what is needed is a VGA controller card with the capability to expand both VGA graphics and text mode displays. At the minimum, such controller has the capability to accommodate the following text mode resolutions: 640×200, 640×350, 640×400, 720×350, and 720×400.

BRIEF SUMMARY OF THE INVENTION

The present invention provides for centering and expanding text and graphics of a standard VGA graphics format within a larger flat panel display (FPD). In the current invention, text and graphics expansion through pixel duplication is performed in both the vertical and horizontal directions to completely fill out a FPD. Text and graphics expansion is accomplished by duplicating pixels according to a scheme formulated based on the current graphics resolution and the desired graphics resolution. In the current invention, all expansion schemes are anticipated and programmed into the system in advance based on the available standard VGA resolutions. Text and graphics expansion are performed separately. With respect to text expansion, horizontal and vertical text expansion are performed following different schemes. On the other hand, horizontal and vertical graphics expansions follow similar schemes.

Independent of expanding a 640×480 pixels resolution format to fill the display area of a larger FPD, the display can be centered within a larger FPD for better aesthetics. The display can alternatively be positioned anywhere else within the larger FPD. Centering and expansion complement each other to give a user a displaying option at any particular time. In the prior art, the control of display position was dependent on the positioning of horizontal and vertical synchronization pulses. The current centering invention does not depend on the timing signals H Sync and V Sync. In that regard, the present centering invention is similar to the relevant part of U.S. Pat. No. 5,293,474 which is entitled "System for Raster Imaging with Automatic Centering and Image Compression." However, the present invention is an improvement of the above patent for the reason stated immediately below.

For CRT displays, the electron beam used for projecting a data stream projects a temporal sequence of images. Each image consists of a vertical sequence of horizontal lines that are themselves sequences of pixels. There exists a lag time between the end of a horizontal line and the beginning of the next horizontal line because the electron beam has to retrace from one horizontal end of the screen to the other end for the start of the next line. Moreover, since the beam also has to be vertically repositioned at the next horizontal line, in retracing, the beam has to move in a diagonal path from the end of one horizontal line to the start of the next horizontal line. FIG. 14 illustrates a typical retracing pattern of a CRT electron beam. In FIG. 14, the solid horizontal lines represent pixels of data and the broken lines represent the retracing paths of the electron beam. During this retracing period, the electron beam must be turned off to prevent any unintentional drawing on the screen. Thus, the total time period for each CRT generated horizontal line is a combination of both the CRT display enabling and disabling periods. The CRT display enable waveforms 1100B and the total time period of a typical CRT generated horizontal line 1104B are illustrated in FIG. 11B. The current centering invention accommodates the scenario in which the total time period of a CRT generated horizontal line is equal to or less than the horizontal enabling time of the larger FPD. To accommodate this scenario, when the original CRT signal is converted into a FPD signal, the horizontal enable time period of this FPD signal is made greater than that of the FPD itself. This novel improvement is important given the fact that the current centering invention does not depend on the positioning of H Sync and V Sync pulse signals.

Prior art references relating to the above invention include Ferraro, Programmer's Guide to the EGA and VGA cards (2d ed. 1993).

Display centering is accomplished by controlling the start and end time of the FPD display enable waveforms relative to the CRT display enable waveforms without relying on the timing signals H Sync and V sync. In the current invention, the start and end time of the FPD display enable waveforms are controlled by pre-programmed values in designated registers. The FPD display enable signal begins when the time value of a start counter reaches the set time in a corresponding start register. Similarly, the FPD display enable signal ends when the time value of the end counter reaches the set time in the corresponding end register.

It is an object of the present invention to provide a video graphics controller that can expand standard VGA graphics resolutions, encompassing both text and graphics modes, to utilize all the display area of a larger FPD.

It is a further object of the present invention to provide a video graphics controller that can position standard VGA graphics resolutions within a larger FPD.

It is a further object of the present invention to provide a video graphics controller that can position standard VGA graphics resolutions within a larger FPD whose horizontal enable time period is equal to or greater than the total time period of the CRT generated horizontal lines.

A still further object is to provide a video graphics controller that offer both expansion and centering as alternative displaying modes for displaying standard VGA graphics resolutions within larger FPDs.

BRIEF DESCRIPTIONS OF THE DRAWINGS

FIG. 12B shows the vertical centering waveforms generated.

DETAILED DESCRIPTION OF THE PREFERRED EMBODIMENT

The present invention includes a method and apparatus for expanding different VGA graphics modes to fill the screen of a large FPD. More specifically, the present invention includes a method and apparatus for expanding text and graphics of standard VGA graphics resolutions. The present invention also includes a method and apparatus for centering or positioning a pixel display format within a large FPD. In addition to utilizing all the available active display area, expansion allows text and graphics to be displayed more proportionately on large display screens. On the other hand, centering allows any pixel display format to be positioned anywhere within a large FPD for functional as well as aesthetic reasons. As such, a user can choose between expansion or centering according to this or her preference. The preferred embodiment of this invention is shown in FIGS. 7A–12B.

Figure 13:
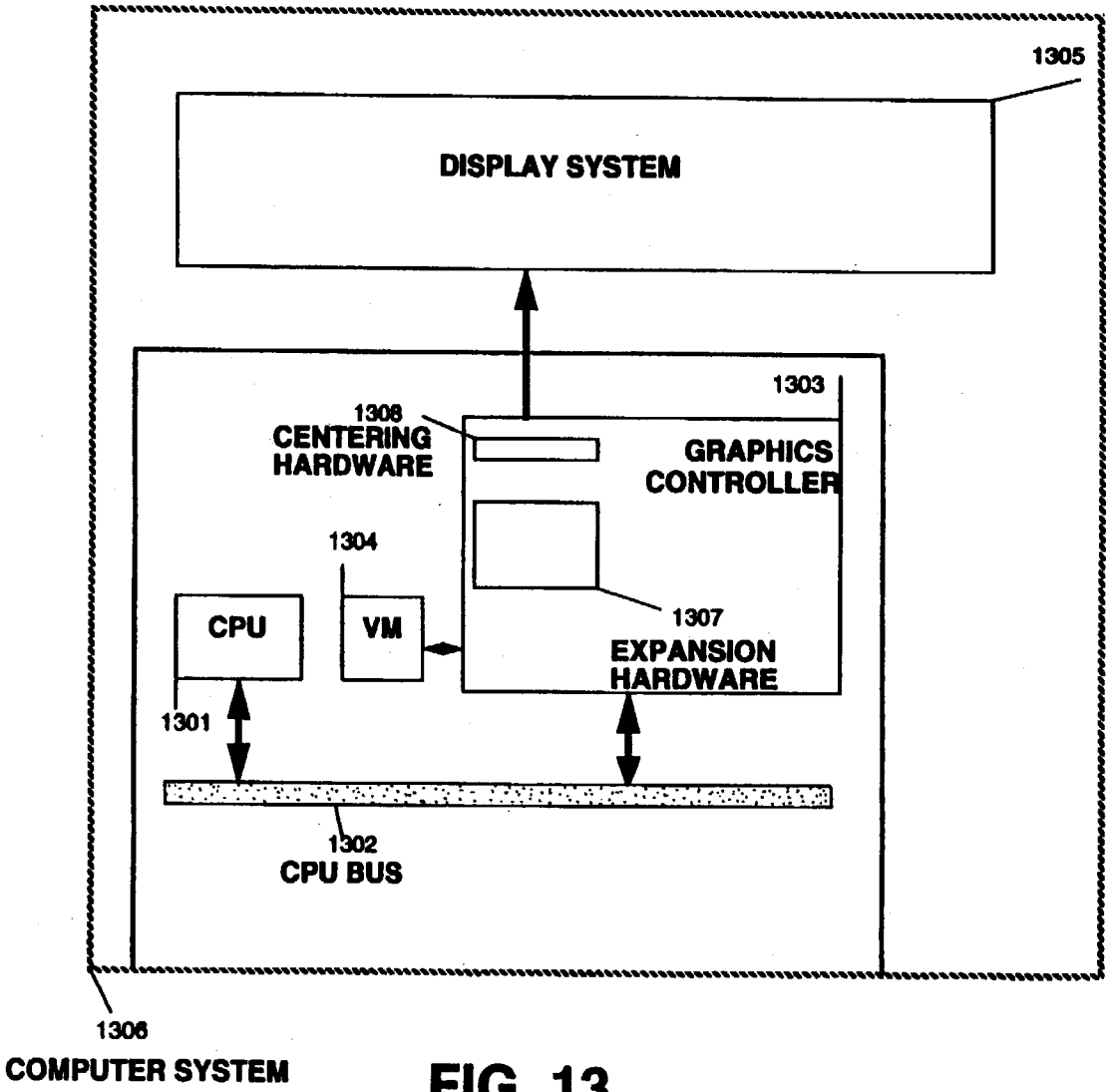
FIG. 13 is a high-level diagram illustrating the overall computer system that utilizes the current invention
Figure 14:
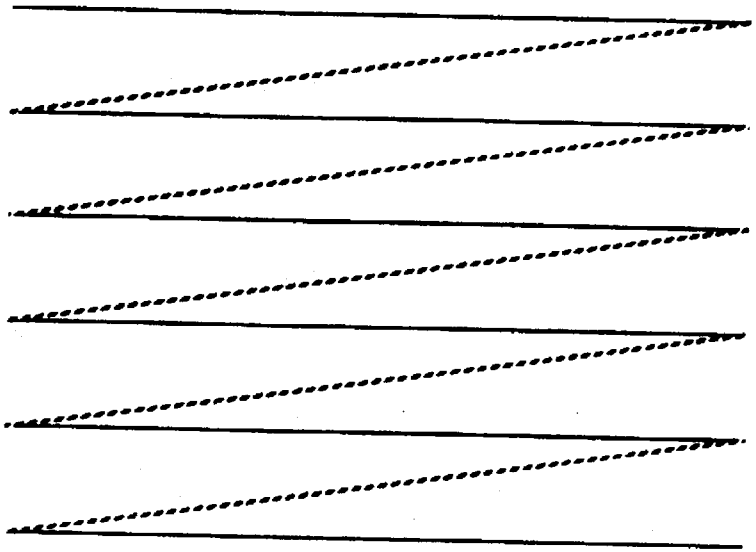
FIG. 14 is a diagram illustrating the horizontal retracing path of a CRT electron beam.

The present invention can be described more easily by first referring to a high level block diagram that shows computer system 1306 with VGA graphics display in which the present invention may be employed. FIG. 13 shows this system which includes computer CPU 1301, CPU bus 1302, VGA graphics controller 1303, video memory 1304, and display system 1305. Computer CPU 1301 interfaces with VGA graphics controller 1303 through CPU bus 1302. In a typical scenario, computer CPU 1301 sends a "free of image" control signal to VGA graphics controller 1303. This control signal commands VGA graphics controller 1303 to access video memory 1304 to retrieve a video image stored at a particular memory address. Upon retrieving this image from video memory 1304, VGA graphics controller 1303 processes the image prior to sending it to display system 1305. The present invention is employed during this processing step. Accordingly, the expanding hardware 1307 and centering hardware 1308 are implemented as part of VGA graphics controller 1303.

Figure 1:
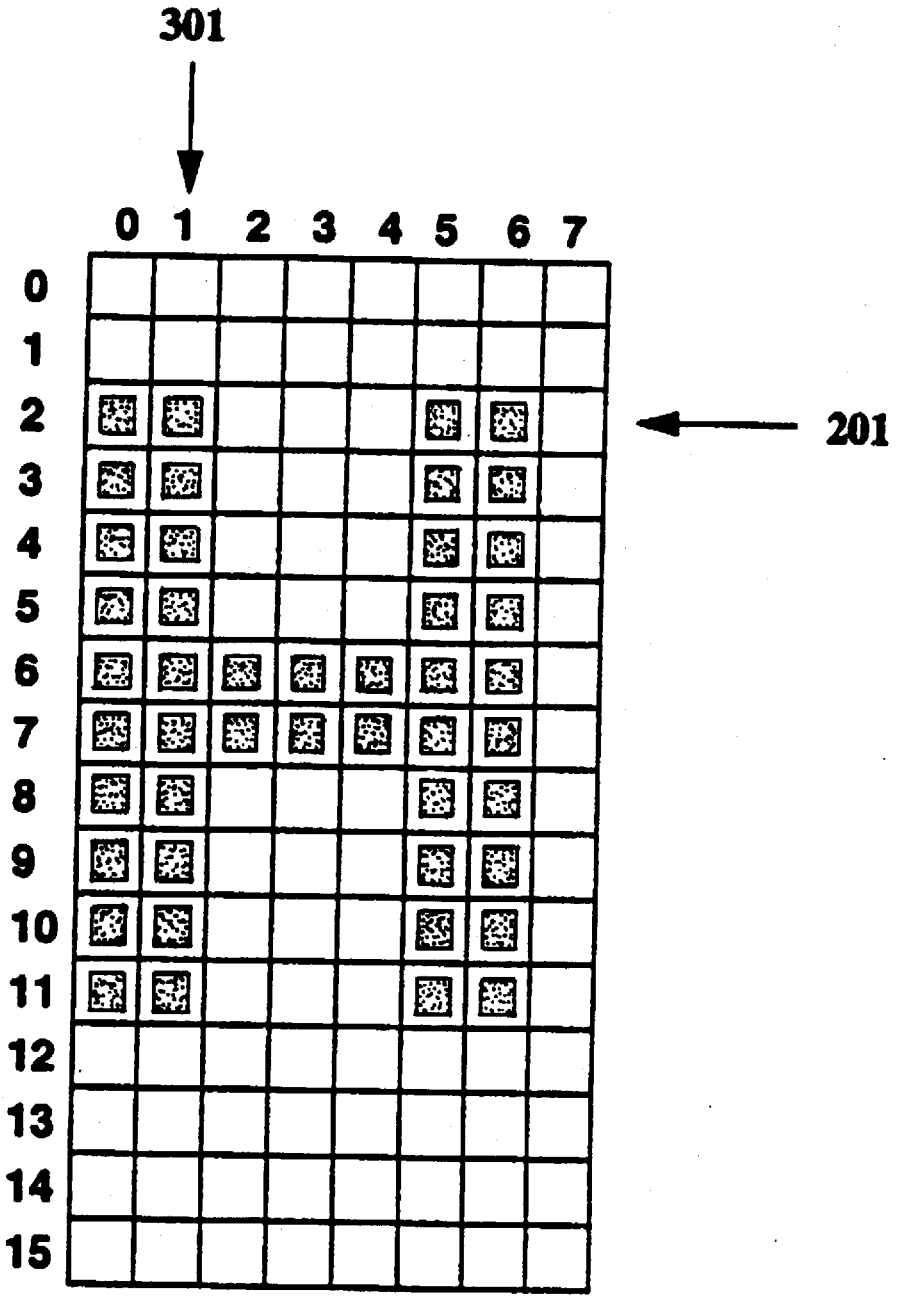
FIG. 1 is a diagram of an 8-by-16 VGA text character font.

With respect to text expansion, FIG. 1 is provided as a tool to aid in the description of the text expansion method. FIG. 1 shows a typical 8-by-16 VGA text character font, the letter "H", of a multiple character font set. As shown in FIG. 1, a text character font typically has blank top and bottom scanlines. Obviously, the exact number of top or bottom blank scanlines depends on the font character size (i.e., 8-by-8, 8-by-14, 8-by-16, 9-by-14, 9-by-16, etc.) and the text letter (i.e., whether the letter has any portion that extends downward or upward such as the lower case letter "y"). Generally, text character fonts are laid onto the screen in a tiled fashion. When that occurs, these blank scanlines serve as vertical intercharacter spacing (i.e., spacing between rows of text characters). As also shown in FIG. 1, a text character font is left-justified within its boundary which means that the far right column is blank. This provides the needed horizontal intercharacter spacing when the text character fonts are placed next to each other. Moreover, FIG. 1 also shows row 201 and column 301 within the text character font which are used below to demonstrate the expansion method for text characters.

In the current invention, while text and graphics share the same vertical expansion scheme and consequently have similar vertical expansion hardware, they have separate horizontal expansion schemes and hardware. This is primarily due to the nature of VGA text character fonts. Depending on the display mode (i.e., 8-by-8, 8-by-14, 9-by-14, 8-by-16, and 9-by-16VGA character fonts), VGA text characters are either 8-dot-wide or 9-dot-wide. Since there are 80 characters in each character row, there are 640 horizontal pixels per scan line in display modes with 8-dot-wide characters. Comparatively, there are 720 horizontal pixels per scan line in display modes with 9-dot-wide characters. Given these characteristics, the 640-to-800 horizontal text expansion mode involves increasing the number of pixels per character width from 8 to 10. Similarly, the 720-to-800 horizontal text expansion mode involves increasing the number of pixels per character width from 9 to 10. Other horizontal text expansion modes are also made feasible by the scheme in the current invention.

Figure 2:
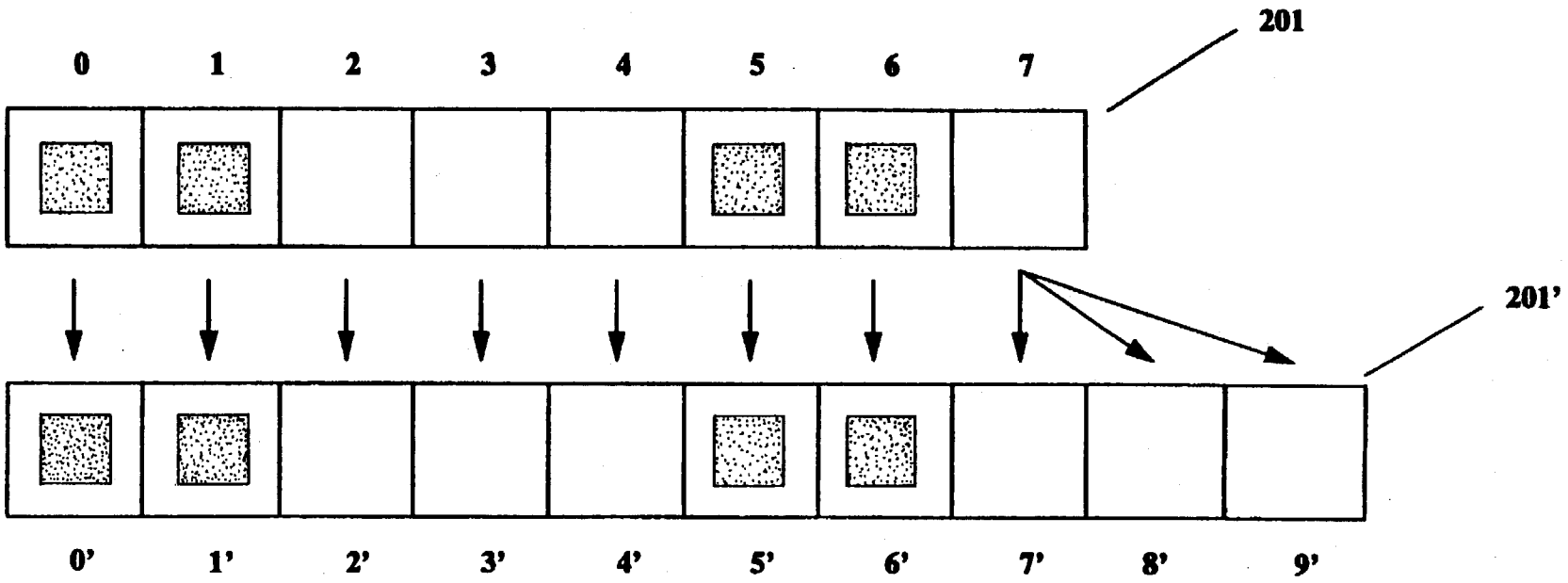
FIG. 2 is a diagram illustrating a method to expand text characters horizontally in accordance with the invention.

In the 640-to-800 horizontal text expansion mode, the eighth (i.e., last) pixel in each VGA text character is duplicated twice. FIG. 2 demonstrates this expansion scheme for text in the horizontal direction. As shown in FIG. 2, row 201, which is a row that contains 8 pixels, is expanded and becomes row 201'. As shown, the eight (i.e., last) pixel in row 201 is duplicated twice. As a consequence, row 201' now contains 10 pixels. This horizontal expansion scheme is desirable because it minimizes distortion of the text character upon expansion. The reason is that the last pixel is normally used as horizontal spacing between characters. As such, characters appear only slightly farther apart following horizontal expansion in the current invention. On the other hand, there are a few VGA text characters that are extended to pixels in the far right column of the text character font. The same is true with regard to some special graphics characters. As a result, when these characters are duplicated in the present invention, only the extension is duplicated which minimizes the distortion. Take for example the letter "Q" , the "tail" of this letter extends pixels in the far right pixel column of the text character font. When the letter "Q" is expanded, only the last column of the character that contains the tail is duplicated. As a result, the distortion is minimized. With respect to the 720-to-800 horizontal text expansion mode, it operates the same way. The difference is that the ninth pixel in each VGA text character is duplicated only once. As such, distortion of the expanded text character is even less in this mode.

Comparatively, the vertical text expansion scheme in the current invention is designed to accommodate different scan-line modes. Given the different character fonts (e.g., 8-by-8, 8-by-14, 8-by-16, etc.) that are available, character fonts can be 8-dot high, 14-dot-high, or 16-dot-high. Moreover, because there are 25 character lines per screen, the different scan line modes available are 200 (8×25), 350 (14×25), and 400 (16×25). Under the current invention's vertical text expansion scheme, a 200-scan-line mode is expanded to a 600-scan-line mode, a 350-scan-line mode is expanded to a 525-scan-line mode, and a 400-scan-line mode is expanded to a 600-scan-line mode. A 200-to-600 expansion is carried out by duplicating every pixel twice. On the other hand, both the 350-to-525 and 400-to-600 expansions are carried out by duplicating every other pixel once. Other expansion modes are also made possible under the current invention.

Figure 3:
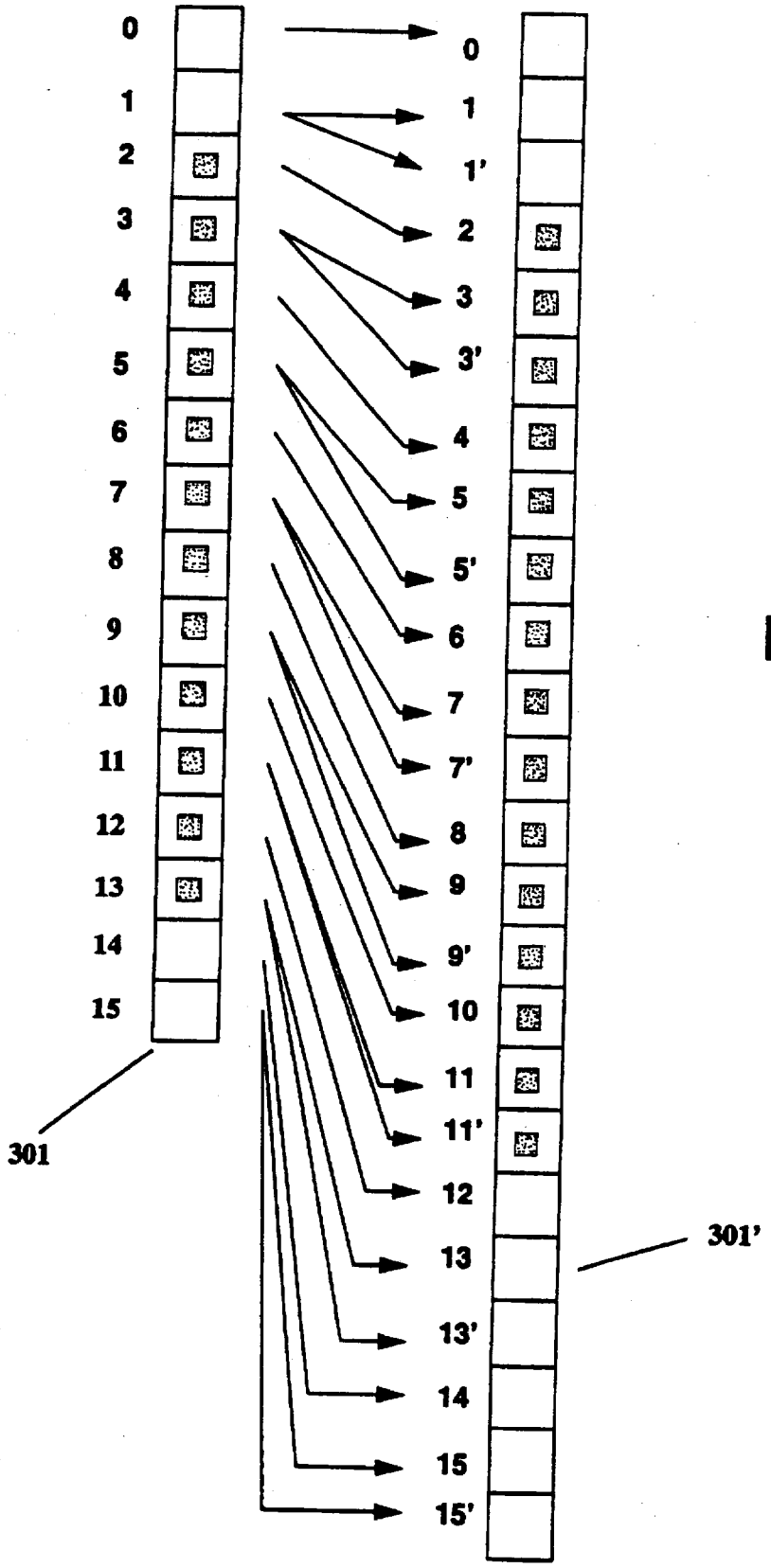
FIG. 3 is a diagram illustrating the inventive method to expand text characters vertically.

FIG. 3 shows a sample of a 400-to-600 vertical expansion for text characters. As shown in FIG. 3, column 301, which is 16-dot-high, is expanded and becomes column 301'. Every other pixel in column 301 is duplicated once. Consequently, column 301' contains 24 pixels. Because there are 25 character lines per screen, there would be a total of 600 scan lines after vertical expansion is completed.

Figure 4:
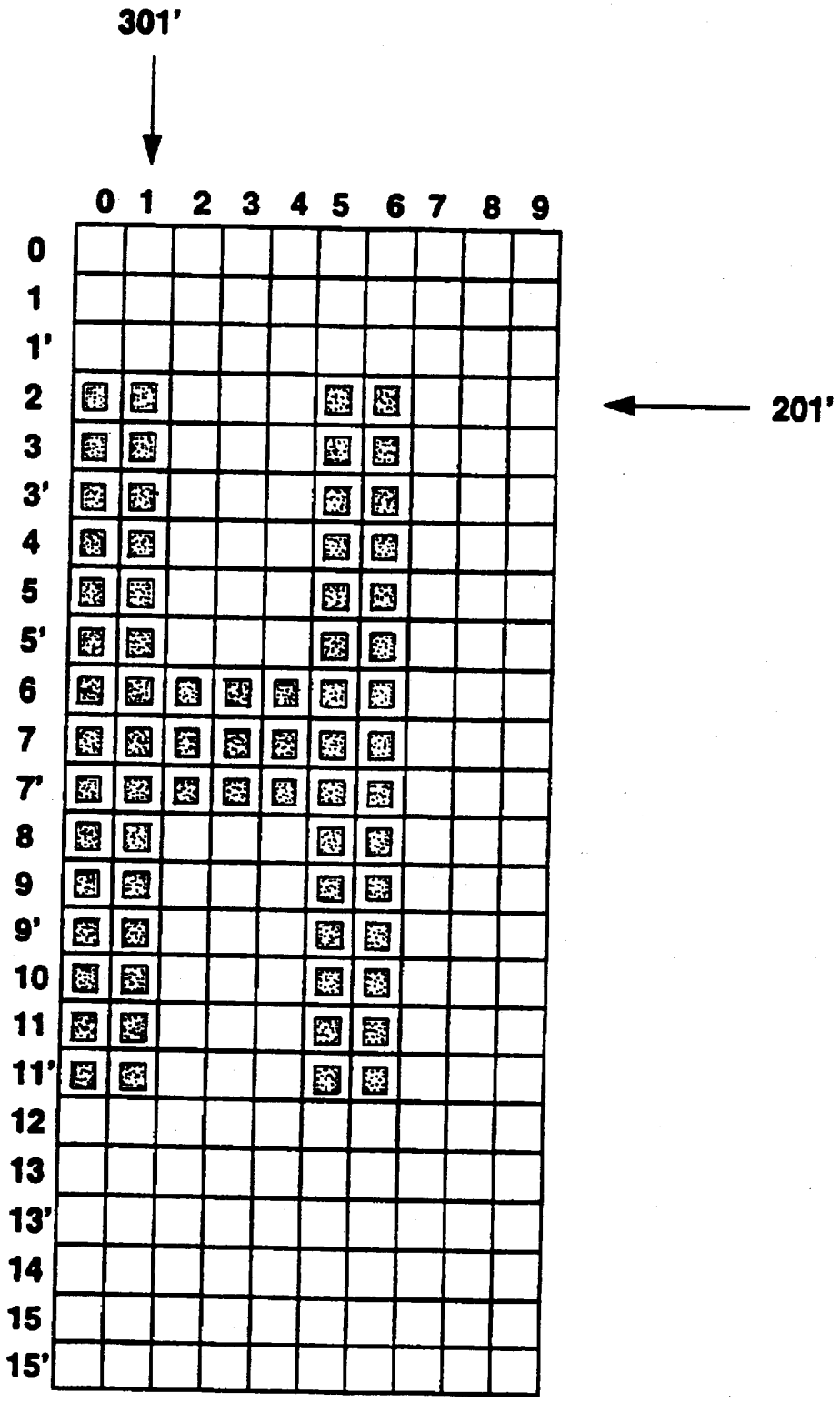
FIG. 4 is a diagram illustrating how an 8-by-16 text character font looks like after being expanded to 10-by-24.

FIG. 4 shows what FIG. 1 looks like after full (i.e., both horizontal and vertical) expansion. Each row and column in FIG. 4 has experienced the expansion illustrated in FIG. 2 and FIG. 3. As a result, FIG. 4 is now a 10-by-24 text character font.

Figure 5A:
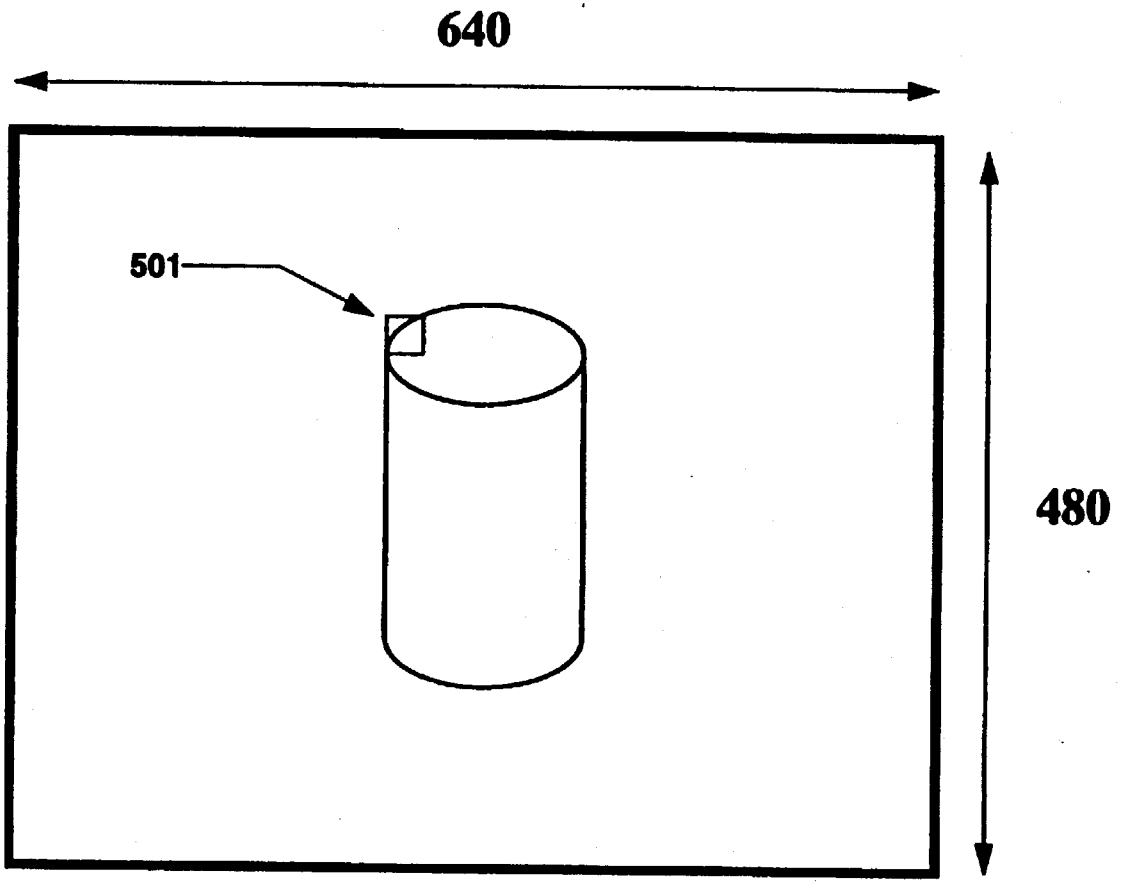
FIG. 5A illustrates a graphics display shown on a 640×480 pixels screen.
Figure 5B:
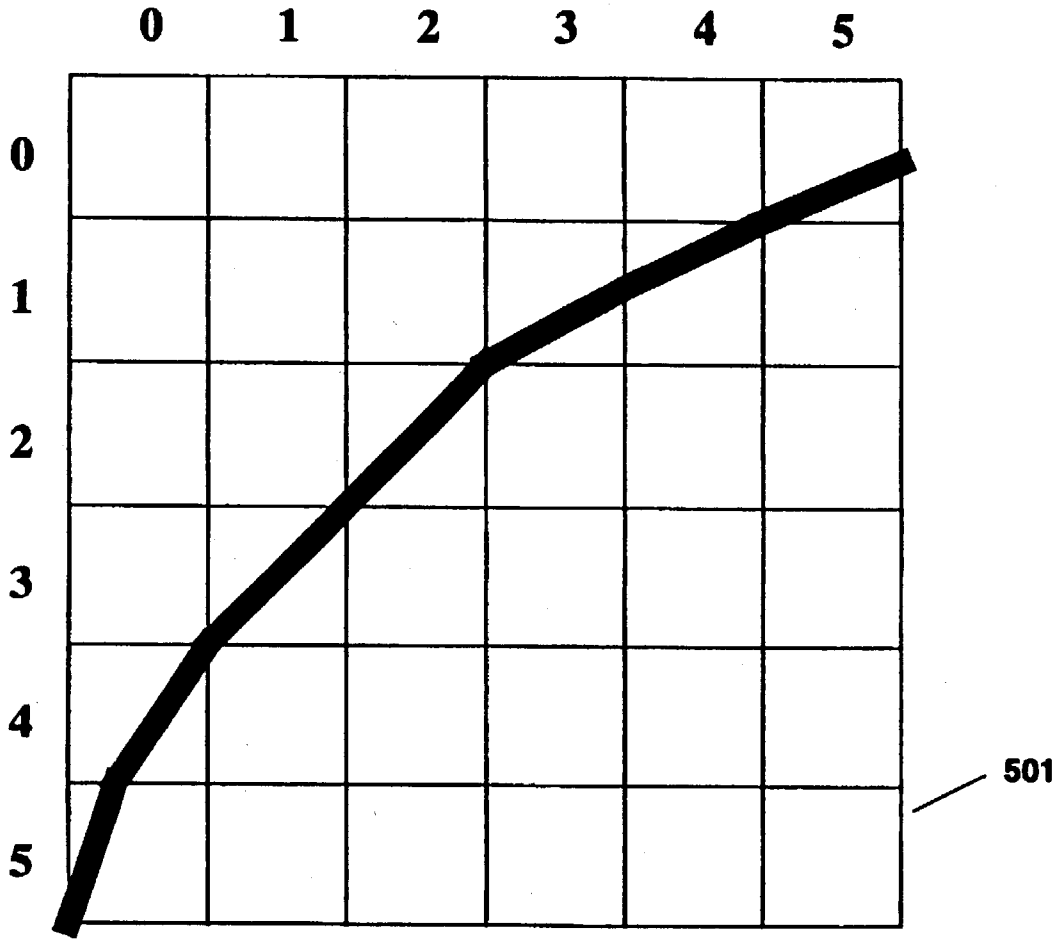
FIG. 5B illustrates a magnified view of a portion of the graphics display as shown on FIG. 5A

In terms of graphics expansion, the current invention teaches how a 640-by-480 display resolution can be expanded to a 800-by-600 display resolution. In other words, graphics are expanded horizontally from 640 pixels to 800 pixels and vertically from 480 pixels to 600 pixels. It may be inferred that expansions of other display resolutions are also feasible under the current invention. As with the case of text expansion, horizontal and vertical graphics expansion are performed separately. However, the methods employed in expanding graphics horizontally and vertically are similar. For horizontal graphics expansion, the 640-to-800 pixel expansion is carried out by duplicating every fourth pixel in each scan line once. Similarly, for vertical graphics expansion, the 480-to-600 pixel expansion is also carried out by duplicating every fourth pixel in each column once. FIG. 5A shows a display of a cylindrical object in 640-by-480 pixel display format. This figure is being used to demonstrate the expansion method for graphics display. FIG. 5A shows area 501 of the cylindrical object. FIG. 5B illustrates a magnified view of area 501 shown in FIG. 5A.

Figure 6A:
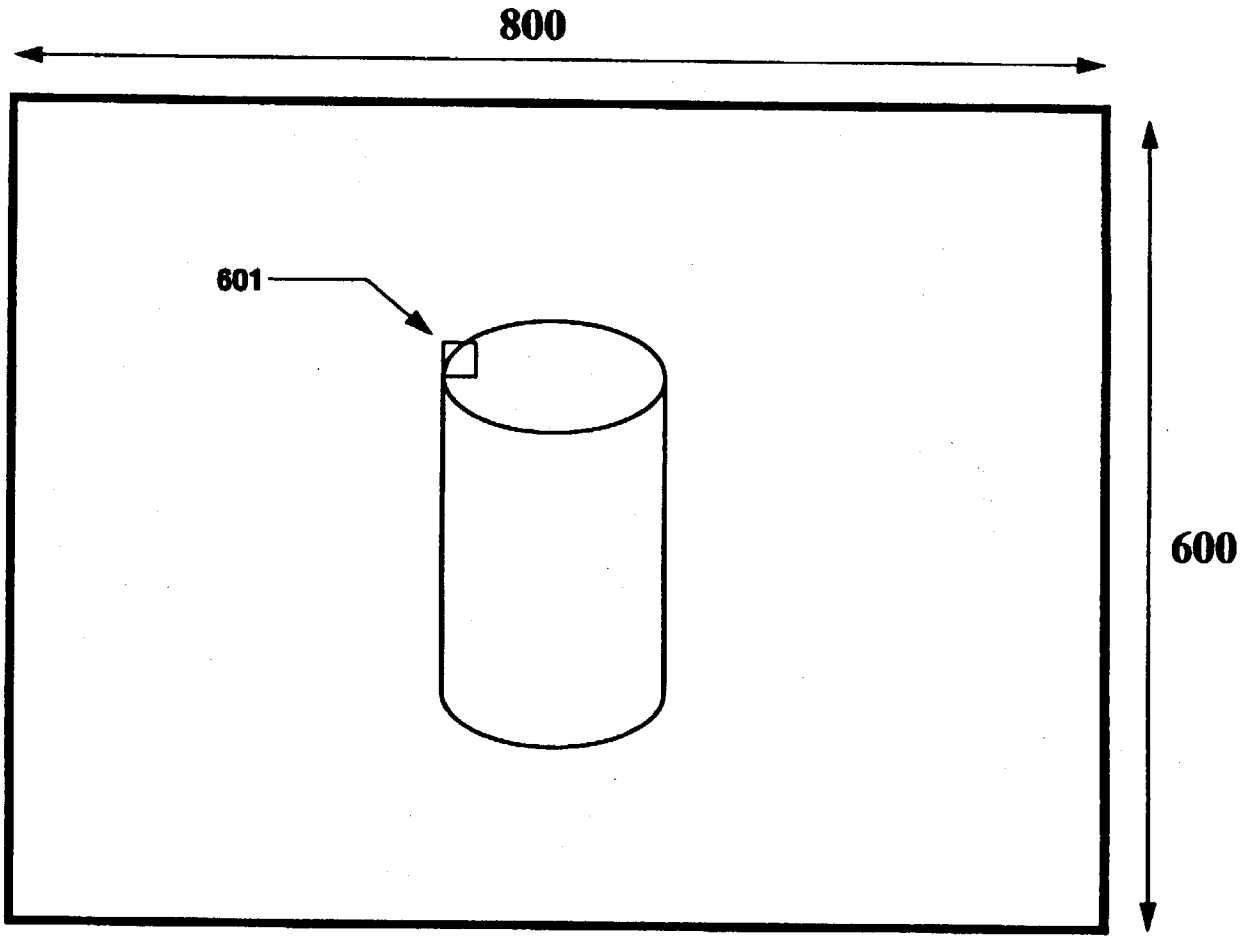
FIG. 6A illustrates an expanded graphics display shown on a 800×600 pixels screen.
Figure 6B:
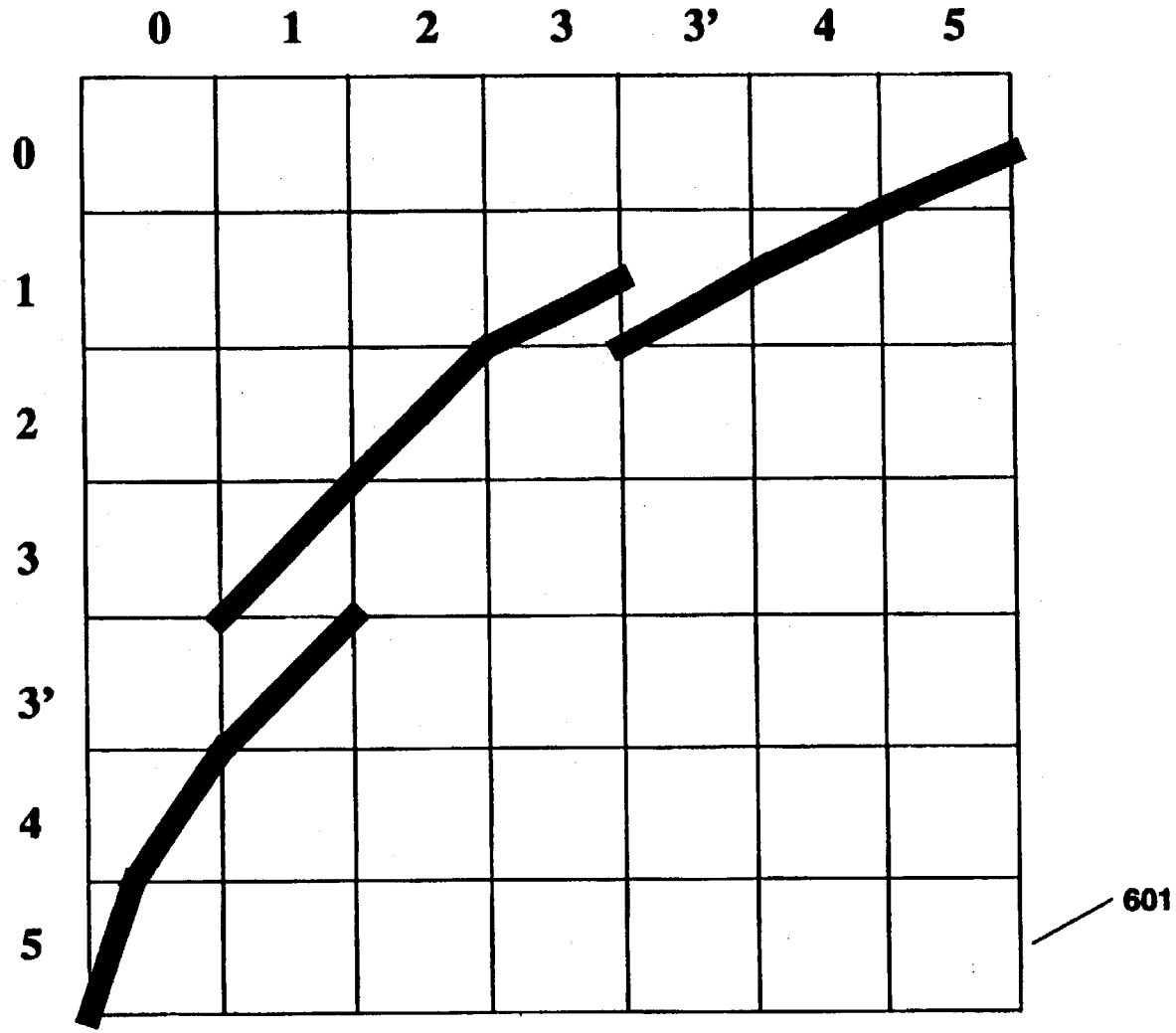
FIG. 6B illustrates a magnified view of a portion of the graphics display as shown on FIG. 6A.

For demonstrative purpose, FIG. 6A illustrates the expansion of a 640-by-480 pixel display format into an 800-by- 600 pixel display format. In particular, FIG. 6A illustrates the expansion of the cylindrical object shown in FIG. 5A. FIG. 6A also shows area 601 of the cylindrical object. FIG. 6B illustrates a magnified view of area 601 shown in FIG. 6A. For the purpose of comparison, area 601 in FIG. 6B is the same area as area 501 in FIG. 5B. As illustrated by FIG. 6B, each fourth row of pixels and each fourth column of pixels are duplicated.

Figure 7A:
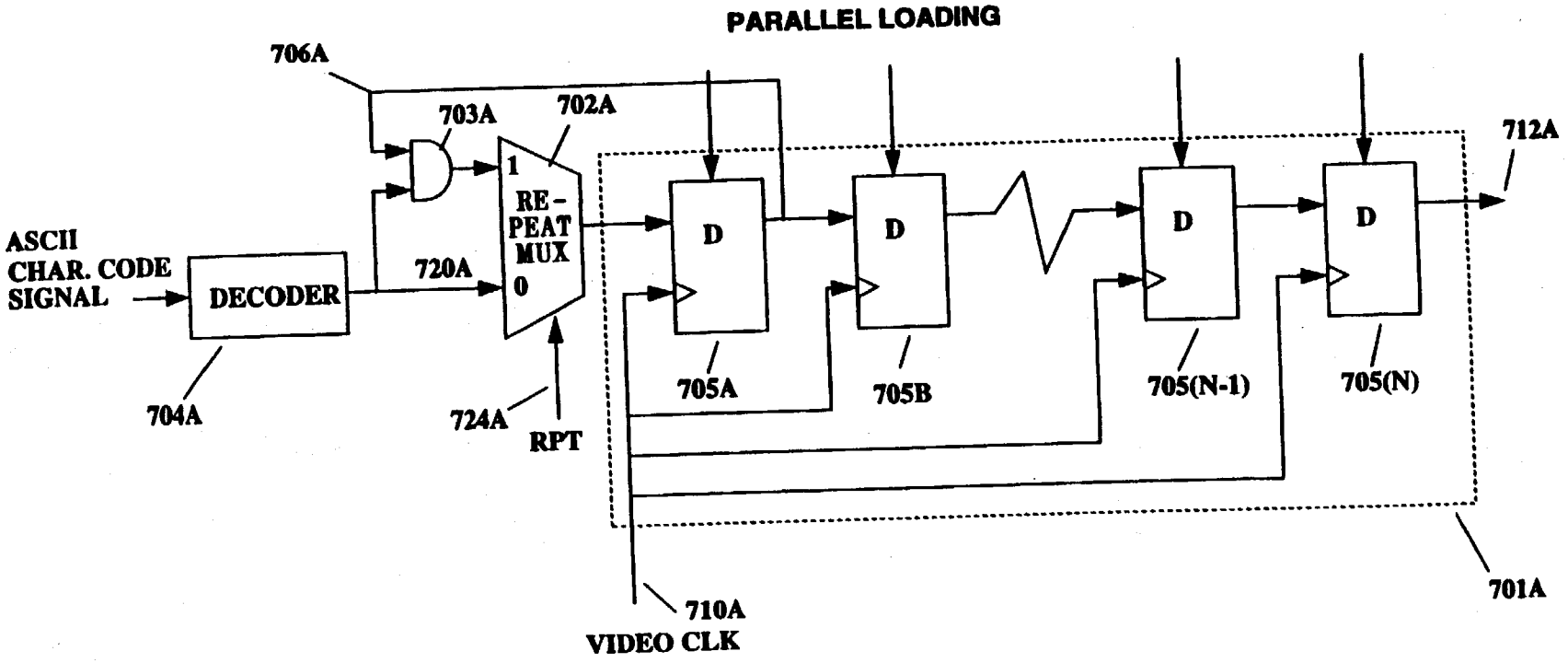
FIG. 7A is a block diagram of the hardware used in expanding text characters horizontally in the present invention.

FIG. 7A is a block diagram of the hardware used in expanding text characters horizontally. As shown in FIG. 7A n-bit shift-register 701A stores binary information that are loaded in parallel into flip-flops 705A–705N that make up the shift register. In the preferred embodiment, shift register 701A consists of 8 clocked D flip flops. Shift-register 701A is clocked by video clock 710A and outputs the stored information serially at 712A. To duplicate the desired pixel during expansion, output 706A from the register's first flip-flop 705A is fed back as an input to AND gate 703A along with the decoded ASCII character code signal. Decoder 704A decodes the ASCII character code to determine whether the far right column of the text character being duplicated is of a background or a foreground color. Such determination is designed to accommodate downward extending characters such as the letter Q. In the current preferred embodiment, the decoded signal output 720A is high for foreground color and low for background color. In the event the far right column is of a foreground color and the feed back signal is also high (demonstrating that the particular pixel is filled), repeat multiplexer 702A outputs a high signal to shift register 701A upon receiving a repeat (RPT) signal 724A. On the other hand, if the far right column is of a background color or if the feed back signal is low (demonstrating that the particular pixel is blank), repeat multiplexer 702A outputs a low signal to shift register 701A upon receiving a RPT signal 724A. Shift-register 701A is parallel loaded again after n+2 clock signals to accommodate the duplication of 2 pixels.

Figure 7B:
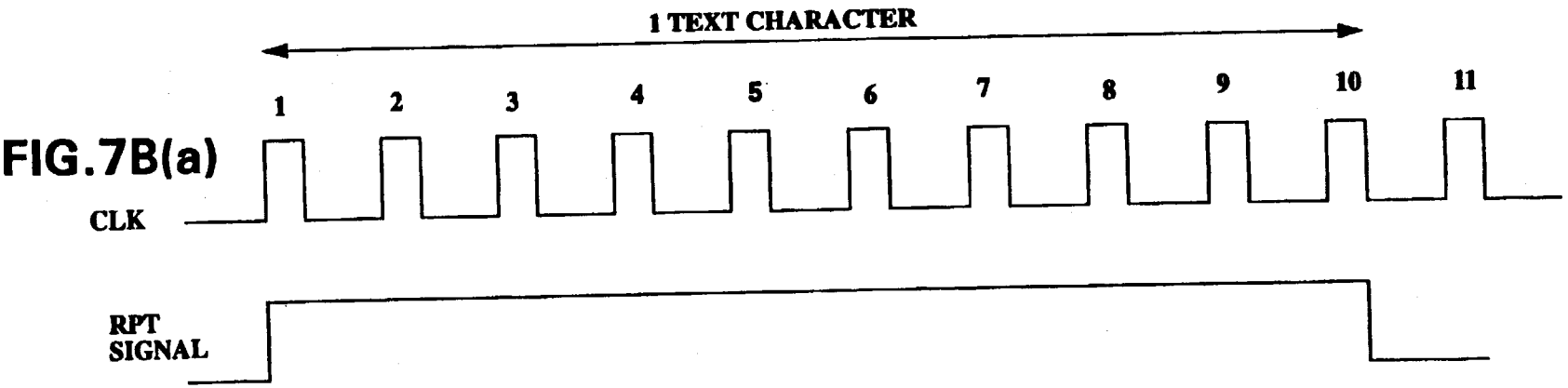
FIG. 7B is a diagram of the horizontal expansion repeat (RPT) signal.

FIG. 7B shows a waveform diagram of the RPT signal 724A. In general, RPT signal stays high for the entire horizontal length of each text character. RPT signal 724A is triggered active by signal 720A which is the decoded signal of the ASCII character code associated with VGA text characters.

Figure 8A:
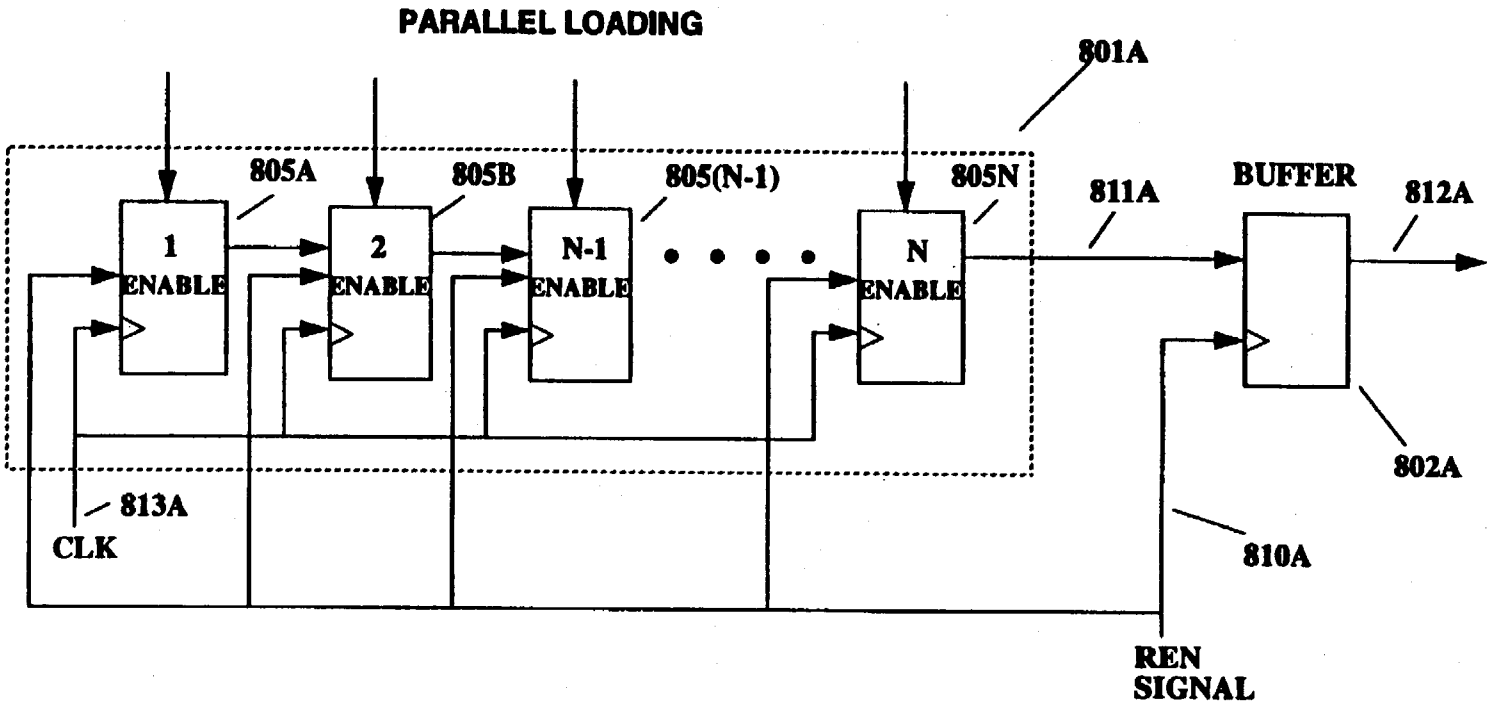
FIG. 8A is a block diagram of the hardware used in expanding graphics horizontally.
Figure 8B:
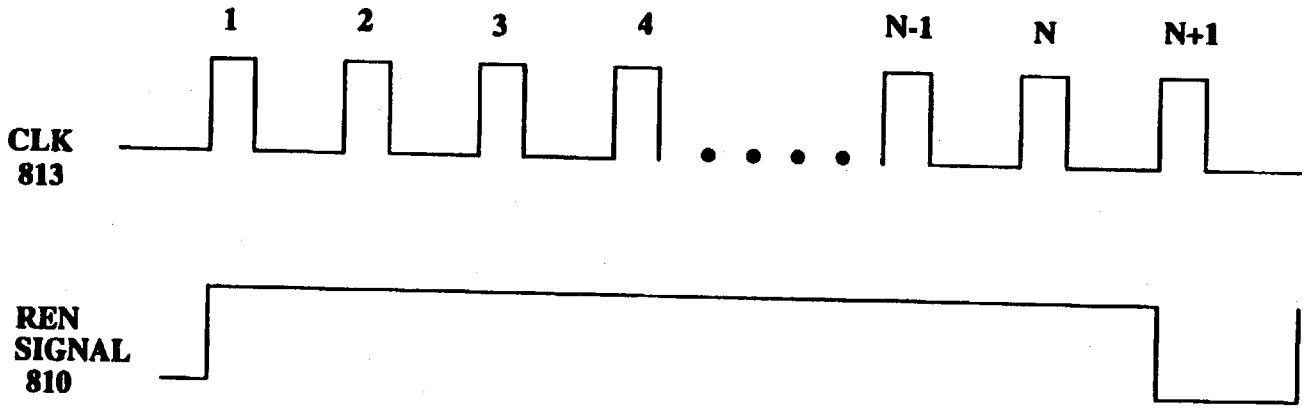
FIG. 8B is a diagram of the receive enable (REN) signal.

FIG. 8A is a block diagram of the hardware used in expanding graphics horizontally. As shown, binary information is parallel loaded into n-bit shift register 801A. Driven by clock pulses 813A, shift register 801A shifts its binary information serially to buffer register 802A. The receive enable (REN) signal 810A controls the ability of buffer register 802A to receive new information. When REN signal 810A is high, buffer register 802A is enabled to receive new binary information 811 from shift register 801A thereby replacing the information stored inside buffer register 802A. When REN signal 810A is low, buffer register 802A retains its current information 812A, thereby allowing this information to be duplicated during the next clock cycle. REN signal 810A is also used to reset flip-flops 805A–805N inside shift register 801A. FIG. 8B shows a waveform diagram of the REN control signal 810A. As shown, REN signal 810A is triggered high for n clock cycles to allow buffer register 802A to receive binary information that are serially shifted from shift register 801A. During the (n+1)th clock cycle, the signal goes low to prevent buffer register 802A from receiving new binary information 811A thereby retaining the current binary information 812A stored in buffer register 802A for duplication purpose.

Figure 9A:
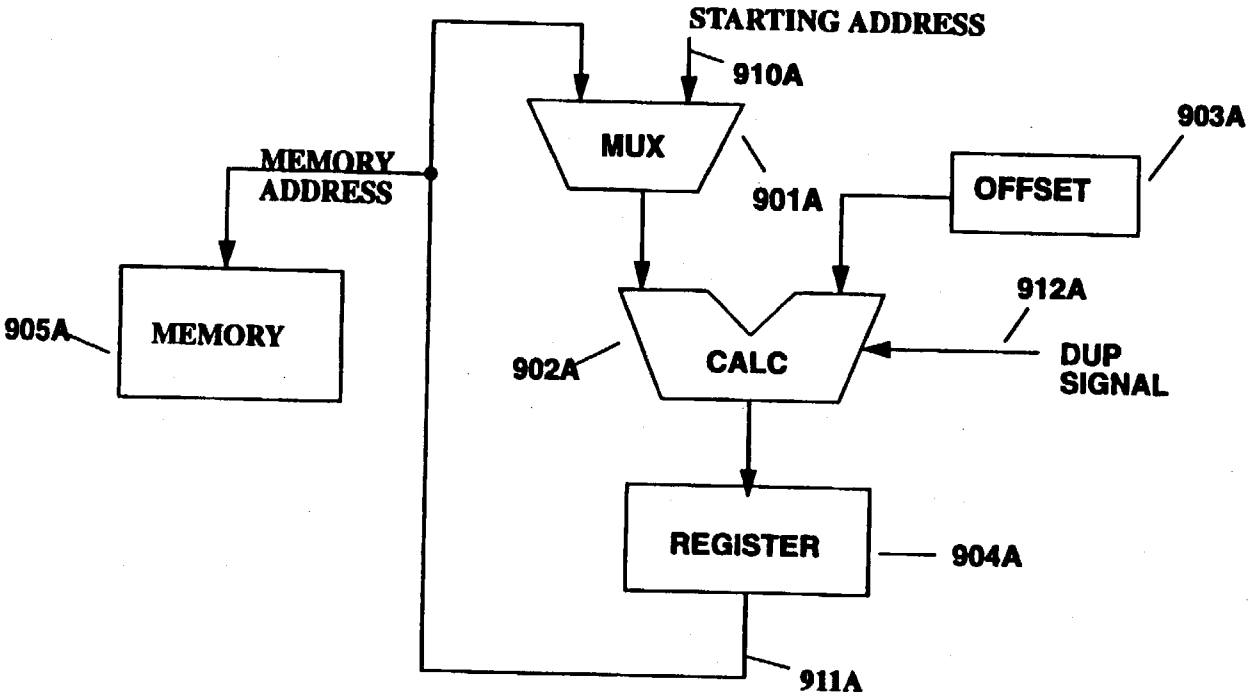
FIG. 9A is a block diagram of the hardware used in expanding text and graphics vertically in the present invention.

FIG. 9A is a block diagram of the hardware used in expanding both text characters and graphics display vertically. Under the current invention, if duplication is not required, an offset value is added to the current memory address to get to the next scan line address. Otherwise, the same scan line address is duplicated. As shown in FIG. 9A, the value of starting memory address 910A, that contains the first scan line of the video memory block, is provided together with output 911A of register 904A as inputs to multiplexer 901A. A detailed discussion about register 904A and output 911A is presented below. When starting address 910A is first provided to multiplexer 901A, multiplexer 901A selects starting address 910A as its input. At other times, multiplexer 901A selects output 911A of register 904A as its input. The reason is evident, starting memory address 910A is only needed when a new block of memory is accessed.

Figure 9B:
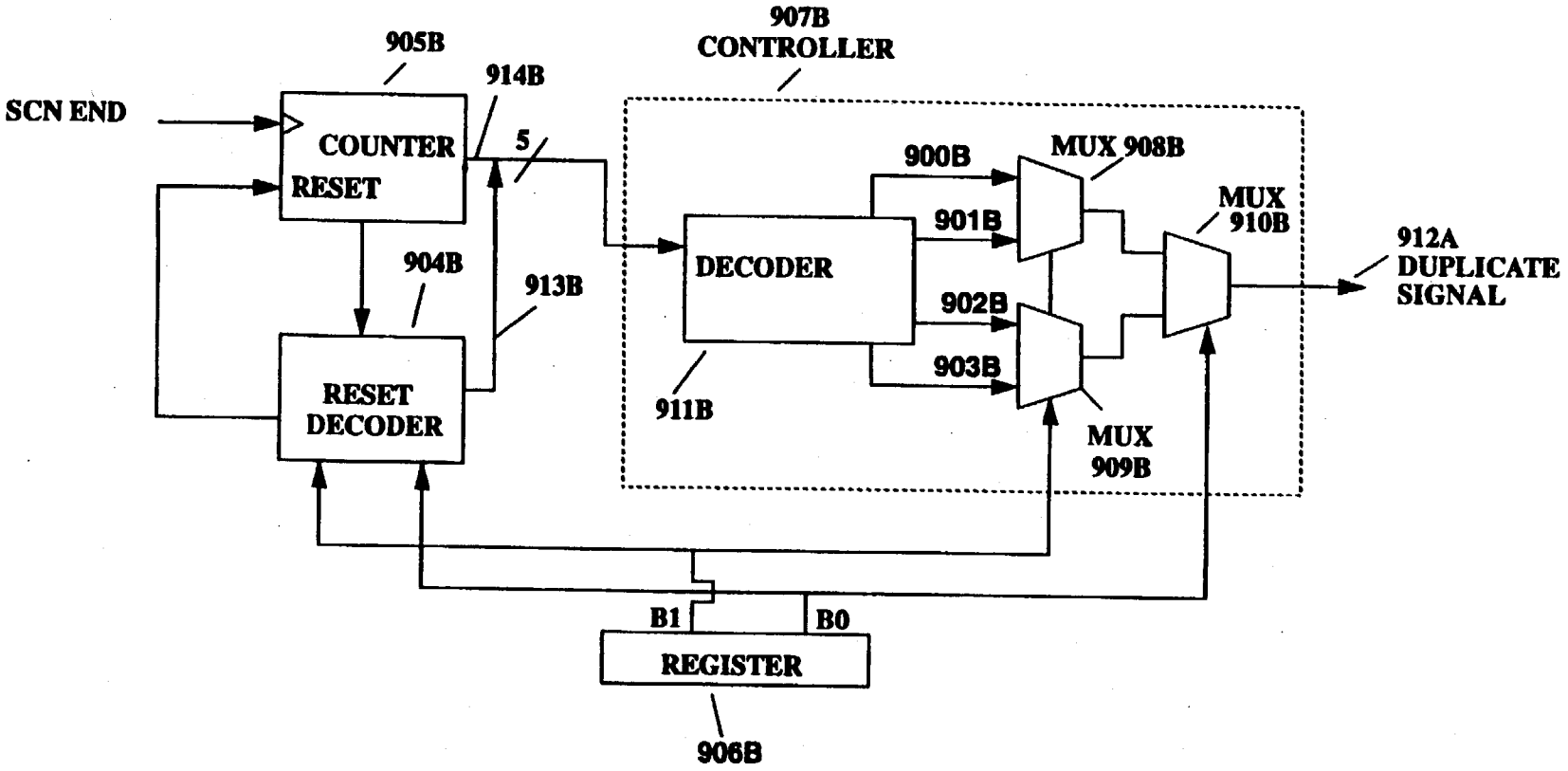
FIG. 9B is a block diagram of the hardware used in generating the vertical expansion duplicate (DUP) signal.

Assume that a new block of memory is to be accessed. When starting memory address 910A is first provided to multiplexer 901A, multiplexer 901A selects starting memory address 910A as its output and feeds this to calculator 902A. A programmable offset value stored in offset register 903A is also provided as an input to calculator 902A. The offset value is used in determining the memory address of the next scan line to access. Duplicate signal (DUP) 912A communicates to calculator 902A as to whether or not calculator 902A should add the offset value to the current memory address value. When no scan line duplication is desired, the next memory address is accessed by adding the offset value to the current memory address value. As output of calculator 902A, this new memory address is fed into register 904A. Otherwise, when pixel duplication is desired, no offsetting is done and the old memory address is accessed again. In other words, the output of calculator 902A remains the same as the output of multiplexer 901A. Because the value of register 904A is the memory address of a scan line, it is used to access the address in memory 905A to retrieve the binary information stored at that address. The output of register 904A is also fed back to multiplexer 901A as mentioned earlier. The next time around, multiplexer 901A selects the output of register 904A as its own output. The process starts over again. FIG. 9B is a block diagram of the hardware used for generating the vertical expansion DUP signal 912A. Register 906B stores the instruction related to the desired vertical expansion mode (i.e., 200-to-600, 350-to-525, 400-to-600, or 480-to-600) in its two least significant bits B1 and B0. Register 906B feeds these two bits to reset decoder 904B which decodes the instruction to determine the count value associated with the desired vertical expansion mode. Reset decoder 904B then sends a signal to counter 905B to signal it to reset and to start counting scanline end pulses. Meanwhile, reset decoder 904B samples the count value generated by counter 905B to make sure that it does not exceed the count value associated with each vertical expansion mode. When the desired count is reached, reset decoder 904B signals to counter 905B to reset and start over. Instruction 913B which is related to the desired vertical expansion mode and count value 914B are fed to controller 907B. Controller 907B comprises a decoder 911B and three multiplexers (908B, 909B, and 910B). Decoder 911B decodes instruction 913B and generates a duplicate signals. Since there are four different vertical expansion modes (i.e., 200-to-600, 350-to-525, 400-to-600, or 480-to-600), there are potentially four different duplicate signals 900B–903B. However, since both the 350-to-525 and 400-to-600 modes use the same vertical expansion scheme, their DUP waveforms are the same. Different DUP signals are discussed in more detail shortly below. The two least significant bits, B1 and B0, of register 906B are used in conjunction with multiplexers 908B, 909B, and 910B to select the desired DUP signal 912A for the current vertical expansion mode.

Figure 9C:
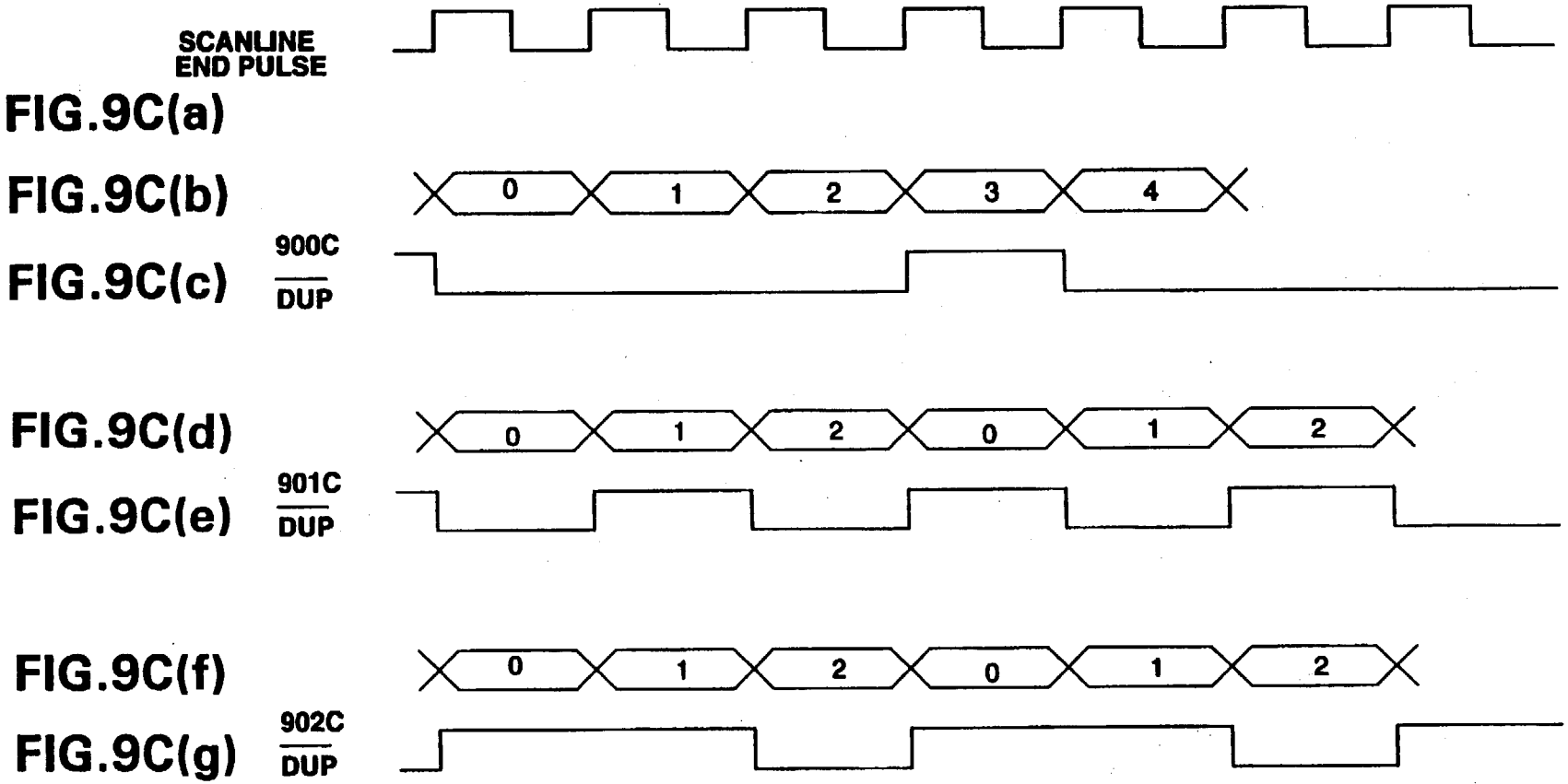
FIG. 9C is a diagram of the DUP waveforms for different modes of expansion.

FIG. 9C shows different DUP waveforms signal generated. As discussed earlier, when DUP signal 912A is high, calculator 903C does not add the offset value to the current memory address value. Rather, the current memory address value is retained for duplication purposes. As shown on FIG. 9C, waveform 900C is the DUP signal associated with vertical expansion mode 480-to-600. The expansion scheme for this mode involves the duplication of every fourth scanline. Hence, DUP signal 912A goes high after the count value reaches 3 (i.e., 0123). Similarly, waveform 901C is the DUP signal associated with vertical expansion modes 350-to-525 and 400-to-600. The expansion scheme for these two modes involves the duplication of every other scanline. As such, DUP signal 912A goes high after the count value reaches 1 (i.e., 01). Waveform 902C is the DUP signal associated with vertical expansion mode 200-to-600. The expansion scheme for this mode involves duplicating every scanline twice. Thus, DUP signal 912A goes high after every scanline end pulse and remains high for the next two counts (i.e., 012).

As an alternative to expanding a display image to fill a larger FPD screen, the current invention also teaches a method to center or otherwise position a display image within a larger FPD screen. In the current invention, centering a display image does not necessarily mean that the display image must be positioned in the center of the larger screen. Rather, a display image can be programmed to be positioned any where on the larger FPD screen. Unlike the prior art, the current invention does not utilize the horizontal and vertical sync signals in centering the display. Additionally, the current invention allows a display image to be centered within a FPD even when the combined total time period of the CRT horizontal enable and disable periods (original values) is equal to or less than the FPD horizontal enable period.

Figure 10:
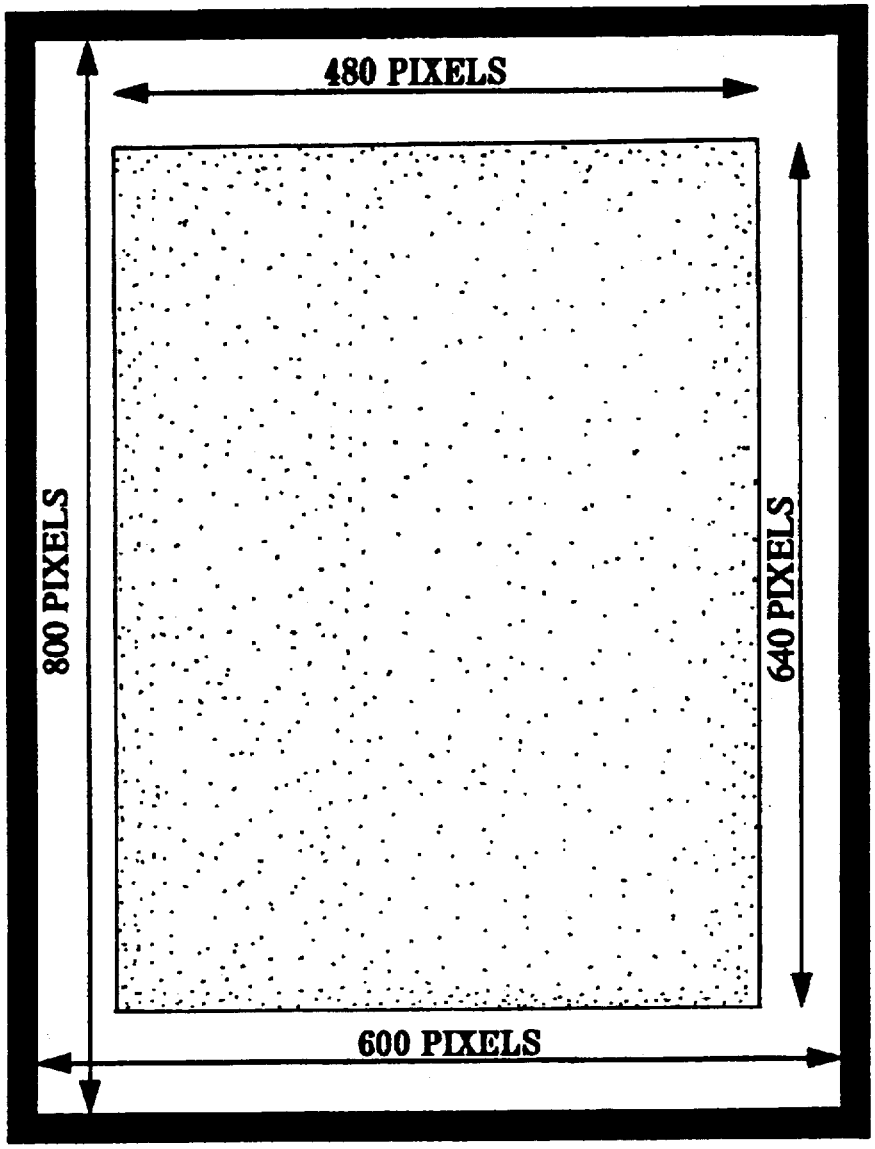
FIG. 10 illustrates the centering of a 640×480 pixels format on a 800×600 monitor screen.
Figures 11A, 11B:
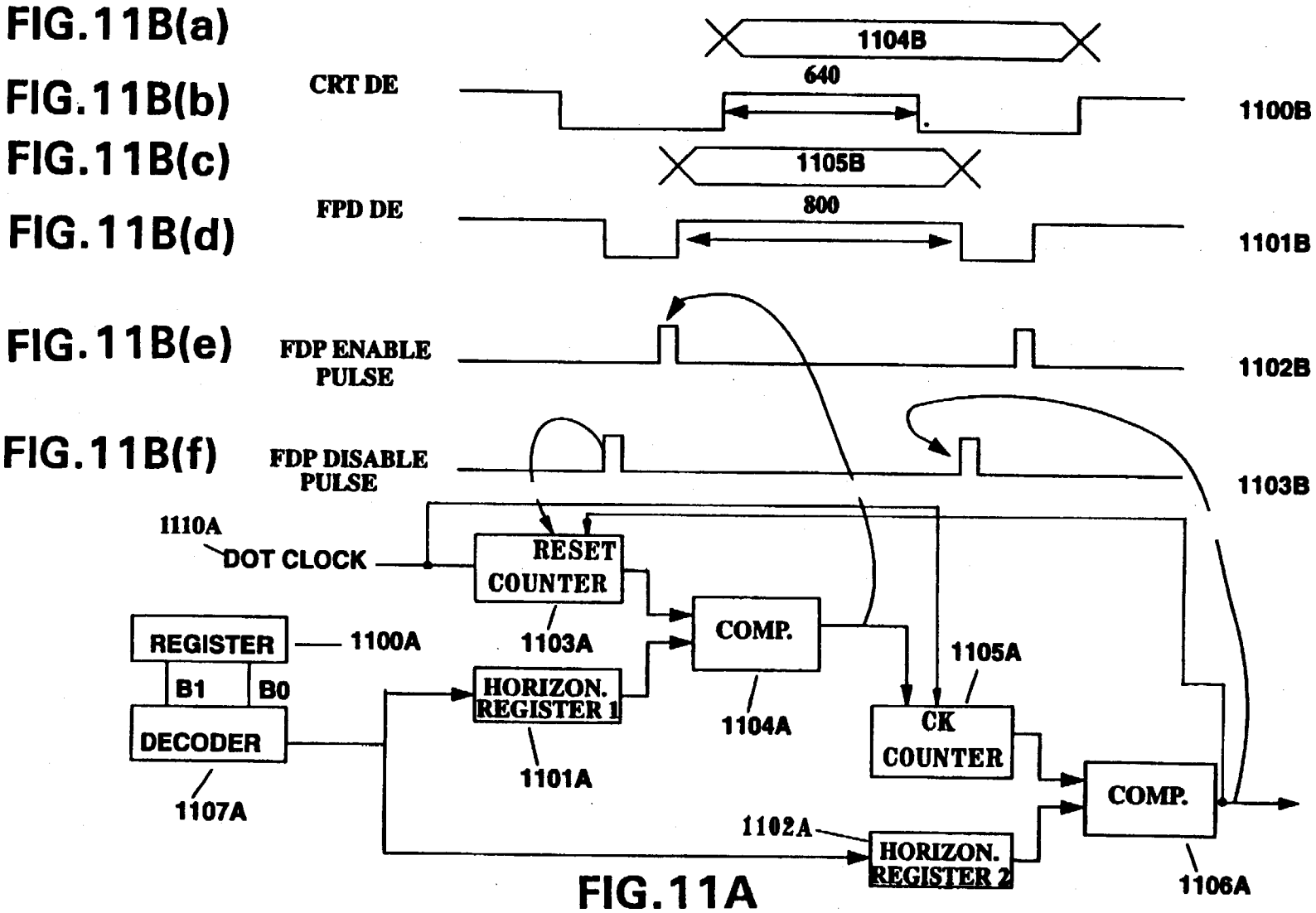
FIG. 11A is a block diagram of the hardware used in generating the horizontal centering waveforms.
FIG. 11B shows the horizontal centering waveforms generated.

FIG. 10 illustrates the centering of a 640×480 pixels display format on a 800×600 monitor screen. To achieve this centering effect, both the horizontal and vertical centering timing signals are generated separately. FIG. 11A is a block diagram of the hardware used in generating the horizontal centering timing signals. FIG. 11B shows the horizontal centering timing waveforms generated. The horizontal centering waveforms are generated in the following sequence. Register 1100A stores the instruction related to the desired resolution display mode (e.g., 640×480, 640×350, 320×200, etc) in its two least significant bits, B0 and B1. Register 1100A feeds these two bits to decoder 1107A which decodes the instruction to determine the respective register values for horizontal registers 1101A and 1102A. Horizontal register 1101A stores the value that corresponds to the time period during which the display panel is disabled. This period corresponds to the first low period on waveform 1101B on FIG. 11B. On the other hand, horizontal register 1102A stores the value that corresponds to the time period during which the panel display is enabled. This period corresponds to the high period on waveform 1101B on FIG. 11B. Driven by the system's dot clock 1110A, counter 1103A starts to count when it is triggered by the display panel's disabling pulse. Comparator 1104A samples the value of counter 1103A and compares it with the value stored in horizontal register 1101A. When the value of counter 1103A reaches the value of horizontal register 1101A, comparator 1104A sends an pulse to enable the display panel and to trigger counter 1105A simultaneously. Similarly, counter 1105A, which is driven by the system's dot clock 1110A, starts to count when it is triggered by the display panel's enabling pulse. Comparator 1106A samples the value of counter 1105A and compares it with the value of horizontal register 1102A. When the value of counter 1105A reaches the value of horizontal register 1102A, comparator 1106A sends a pulse to disable the display panel. When the CRT display enable signal reset counter 1103A, the sequence described above begins all over again.

In FIG. 11B, the total time period of a CRT generated horizontal line is indicated by reference designator 1104B. As shown, this total time period is a combination of both an enable and the immediate subsequent disable period. On the other hand, period 1105B represents the horizontal enable time period of the FPD. When the total time period of the CRT generated horizontal lines is equal to or less than the total enable period of the FPD, the FPD experiences problems with its timing. To overcome this problem, horizontal register 1102A is programmed to have a value that is greater than the total time period of the CRT generated horizontal lines.

Figure 12A:
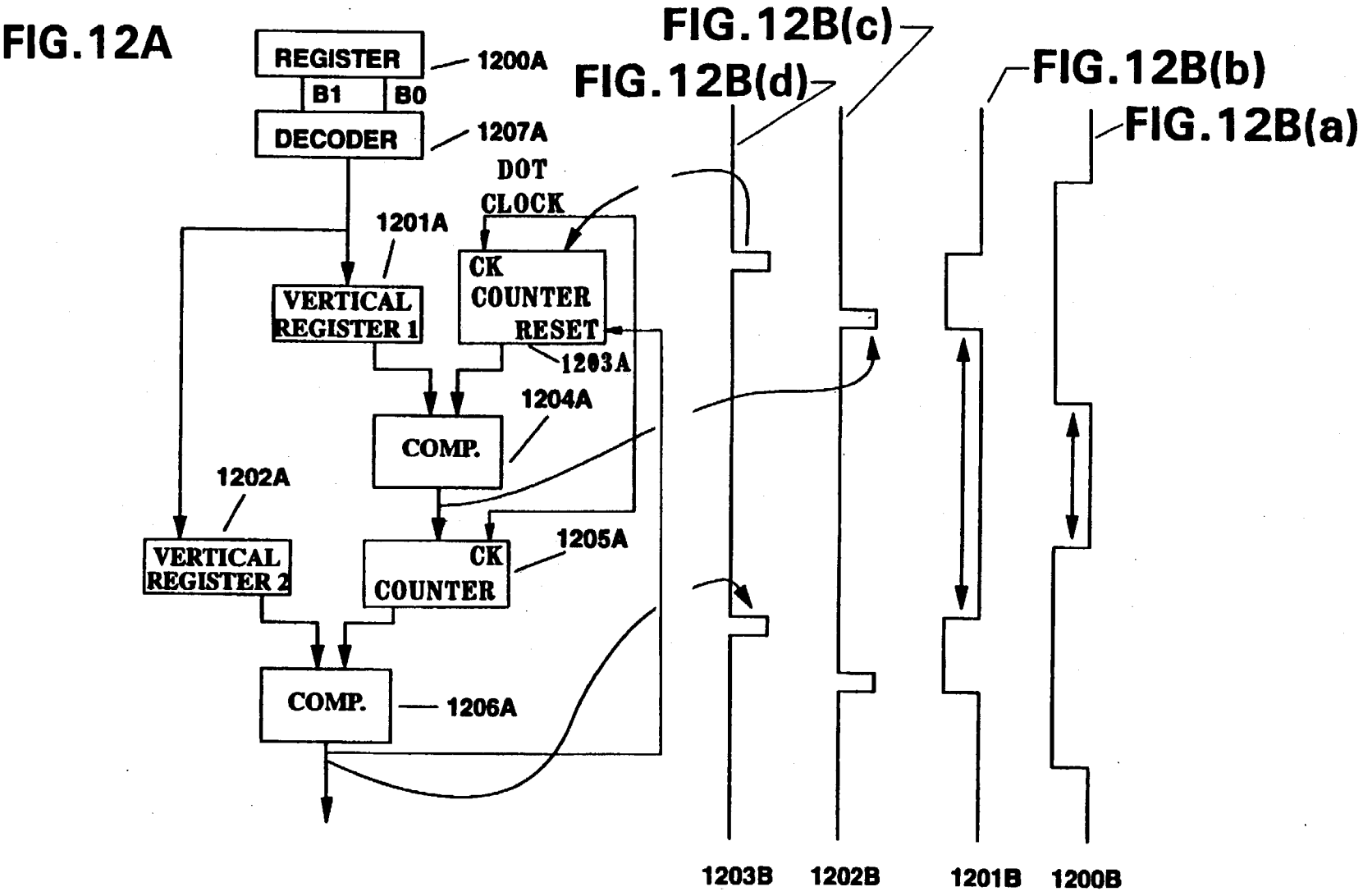
FIG. 12A is a block diagram of the hardware used in generating the vertical centering waveforms.

The vertical centering timing signals can be generated the same way. FIG. 12A is a block diagram of the hardware used in generating the vertical centering waveforms. FIG. 12B shows the generated vertical centering waveforms. The vertical centering waveforms are generated in the following sequence. Register 1200A stores the instruction related to the desired resolution display mode (e.g., 640×480, 640×350, 320×200, etc) in its two least significant bits, B0 and B1. Register 1200A feeds these two bits to decoder 1207A which determines the respective register values for Vertical Registers 1201A and 1202A. Vertical register 1201A stores a value that corresponds to the time period during which the panel display is disabled. The disabling periods are represented by the depressions on waveform 1201B on FIG. 12B. On the other hand, vertical register 1202A stores the value that corresponds to the time period during which the panel display is enable. The enabling periods are represented by the high periods on waveform 1201B on FIG. 2B. Driven by the system's dot clock, when counter 1203A is triggered by the display panel disabling pulse, it starts to count. Comparator 1204A samples the current value of counter 1203A and compares it with the value stored in vertical register 1201A. When the value of counter 1203A reaches the value of vertical register 1201A, comparator 1204A sends an pulse to simultaneously enable the display panel and trigger counter 1205A. When counter 1205A, which is also driven by the system's dot clock, is triggered, it starts to count. Comparator 1206A samples the current value of counter 1205A and compares it with the value of vertical register 1202A. When the value of counter 1205A reaches that of vertical register 1202A, comparator 1206A sends a pulse to disable the display panel. When the CRT display enable signal reset counter 1203A, the sequence described above begins all over again.

We claim:

1. An apparatus for horizontally positioning a video graphics adapter (VGA) display image on the screen of a flat panel display (FPD), comprising:

first counter means for setting a horizontal FPD disable period associated with said FPD;

second counter means for setting a horizontal FPD enable period of said FPD, said horizontal FPD enable period being greater than a composite horizontal pixel time of a VGA image to be displayed;

first circuit means for controlling the start time of a subsequent horizontal FPD enable period, said start time being based on said horizontal FPD disable period;

second circuit means for controlling the end time of said subsequent horizontal FPD enable period, said end time being based on said horizontal FPD enable period; and means for beginning said VGA display image based on said start time of said subsequent horizontal FPD enable period to locate said VGA display image at a desired horizontal position of said FPD screen.

2. The apparatus of claim 1 wherein said horizontal position is the horizontal center of said FPD screen.

3. A method for horizontally positioning a video graphics array (VGA) display image on the screen of a flat panel display (FPD), comprising the steps of:

storing in a first storage circuit a horizontal disable period associated with said FPD;

storing in a second storage circuit a horizontal enable period associated with said FPD, said horizontal FPD enable period being greater than a composite horizontal pixel time of a VGA display; controlling the start time of a subsequent horizontal FPD enable period, said start time being based on said stored horizontal FPD disable period;

controlling the end time of said subsequent horizontal FPD enable period, said end time being based on said stored horizontal FPD enable period; and starting said VGA display image based on said start time of said subsequent horizontal FPD enable period to locate said VGA display image at a desired horizontal position of said FPD screen.

4. The method of claim 3 wherein said desired horizontal position is the horizontal center of said FPD screen.

5. An apparatus for vertically positioning a video graphics display (VGA) image on the screen of a flat panel display (FPD), comprising:

first counter means for setting a vertical disable period associated with the FPD;

second counter means for setting a vertical enable period associated with the FPD;

first circuit means for controlling the start time of a subsequent vertical FPD enable period, said start time being based on said vertical FPD disable period;

second circuit means for controlling the end time of said subsequent vertical FPD enable period, said end time being based on said vertical FPD enable period; and means for starting said VGA display image based on said start time of said subsequent vertical FPD enable period to locate said VGA display image at a desired vertical position of said FPD screen.

6. The apparatus of claim 5, wherein said desired vertical position is the vertical center of said FPD screen.

7. A method for vertically positioning a video graphics array (VGA) display image on the screen of a flat panel display (FPD), comprising the steps of:

storing in a first storage circuit a vertical disable period associated with said FPD;

storing in a second storage circuit a vertical enable period associated with said FPD;

controlling the start time of a subsequent vertical FPD enable period, said start time being based on said stored vertical FPD disable period;

controlling the end time of said subsequent vertical FPD enable period, said end time being based on said stored vertical FPD enable period; and starting said VGA display image based on said start time of said subsequent vertical FPD enable period to locate said VGA display image at a desired vertical position of said FPD screen.

8. The method of claim 7 wherein said desired vertical position is the vertical center of said FPD screen.

9. An apparatus for horizontally and vertically positioning a visual graphics array (VGA) display image on the screen of a flat panel display (FPD), comprising:

first counter means for setting both horizontal and vertical disable periods associated with said FPD;

second counter means for setting both horizontal and vertical enable periods of said FPD, said horizontal FPD enable period being greater than a composite horizontal pixel time of a VGA image display;

first circuit means for controlling the start times of subsequent horizontal and vertical FPD enable periods, said start times of said subsequent horizontal and vertical FPD enable periods being based on said horizontal and vertical FPD disable periods;

second circuit means for controlling the end times of said subsequent horizontal and vertical FPD enable periods, said end times of said subsequent horizontal and vertical FPD enable periods being based on said horizontal and vertical FPD enable periods; and means for starting said VGA display image based on said start times of said subsequent horizontal and vertical FPD enable periods to locate said VGA display at a desired position of said FPD screen.

10. The apparatus of claim 9 wherein said desired position is the horizontal and vertical center of said FPD screen.

11. A method for horizontally and vertically positioning a video graphics array (VGA) display image on the screen of a flat panel display (FPD), comprising the steps of:

setting horizontal and vertical disable periods associated with said FPD;

setting horizontal and vertical enable periods associated with said FPD, said horizontal FPD enable period being greater than a composite horizontal pixel time of a VGA image display;

controlling the start times of subsequent horizontal and vertical FPD enable periods, said start times of said subsequent horizontal and vertical FPD enable periods being based on said horizontal and vertical FPD disable periods, respectively;

controlling the end times of said subsequent horizontal and vertical FPD enable periods, said end times of said subsequent horizontal and vertical FPD enable periods being based on said horizontal and vertical FPD enable periods, respectively; and starting said VGA display image based on said start times of said subsequent horizontal and vertical FPD enable periods to locate said VGA display image at a desired position of said FPD screen.

12. The method of claim 11 wherein said desired position is the horizontal and vertical center of said FPD screen.

* * * * *